US008485363B2

(12) United States Patent
Nagelvoort et al.

(10) Patent No.: US 8,485,363 B2
(45) Date of Patent: Jul. 16, 2013

(54) DEVICE FOR AND METHOD OF SEPARATING SOLID MATERIALS ON THE BASIS OF A MUTUAL DIFFERENCE IN DENSITY

(75) Inventors: Gerrit Dinand Klein Nagelvoort, Vroomshoop (NL); Hendrik Jan Klein Nagelvoort, Vroomshoop (NL); Erwin Johannes Bakker, Den Haag (NL)

(73) Assignees: Bakker Holding Son B.V., Son en Breugel (NL); AKG Polymers B.V., Vroomshoop (NL)

( * ) Notice: Subject to any disclaimer, the term of this patent is extended or adjusted under 35 U.S.C. 154(b) by 206 days.

(21) Appl. No.: 13/103,210

(22) Filed: May 9, 2011

(65) Prior Publication Data

US 2011/0278204 A1 Nov. 17, 2011

(30) Foreign Application Priority Data

May 12, 2010 (NL) ..... 2004717

(51) Int. Cl.
*B03C 1/30* (2006.01)

(52) U.S. Cl.
USPC ..... 209/39; 209/1; 209/155; 209/172.5; 209/454; 209/655; 210/94; 210/223

(58) Field of Classification Search
USPC ..... 209/1, 39, 40, 655
See application file for complete search history.

(56) References Cited

U.S. PATENT DOCUMENTS

| | | | | |
|---|---|---|---|---|
| 3,483,968 | A | 12/1969 | Kaiser | 209/1 |
| 3,483,969 | A * | 12/1969 | Rosensweig | 209/1 |
| 3,788,465 | A * | 1/1974 | Reimers et al. | 209/1 |
| 3,966,590 | A * | 6/1976 | Boom et al. | 209/39 |
| 4,062,765 | A * | 12/1977 | Fay et al. | 209/1 |
| 4,521,303 | A * | 6/1985 | Hicks et al. | 209/454 |
| 4,935,122 | A * | 6/1990 | Dreyfuss | 209/39 |
| 5,039,426 | A | 8/1991 | Giddings | 210/695 |
| 5,541,072 | A | 7/1996 | Wang et al. | 435/7.21 |
| 6,026,966 | A | 2/2000 | Svoboda | 209/172.5 |
| 6,136,182 | A | 10/2000 | Dolan et al. | 210/94 |
| 7,753,211 | B2 | 7/2010 | Rem et al. | 209/39 |
| 2005/0230299 | A1 | 10/2005 | Saho et al. | 210/223 |
| 2007/0163926 | A1 | 7/2007 | Rem et al. | 209/155 |
| 2007/0278156 | A1 | 12/2007 | Garrison | 210/695 |

(Continued)

FOREIGN PATENT DOCUMENTS

| | | |
|---|---|---|
| AU | 612658 B | 7/1991 |
| DE | 3624626 | 1/1988 |

(Continued)

*Primary Examiner* — Terrell Matthews

(74) *Attorney, Agent, or Firm* — Roberts & Roberts, LLP

(57) ABSTRACT

The present invention relates to a device for separating solid materials on the basis of a mutual difference in density, wherein the materials to be separated are brought into contact with a magnetic fluid across which fluid a density gradient is generated by means of a magnetic field such that fractions of solid materials of different densities are obtained, said device being provided with a magnet, an inflow chamber, a separation chamber, and means for discharging fractions of solid materials of different densities in separation, wherein the magnetic fluid flows from the inflow chamber to the separation chamber, wherein the magnet is arranged above the separation chamber, and wherein at least one duct for the supply of the solid materials to be separated is located below the inflow chamber and the separation chamber and encloses an angle with the inflow chamber and the separation chamber.

19 Claims, 2 Drawing Sheets

U.S. PATENT DOCUMENTS

| | | | | |
|---|---|---|---|---|
| 2009/0236269 | A1 | 9/2009 | Kojima | 209/655 |
| 2009/0266768 | A1 | 10/2009 | Garrison | 210/695 |
| 2009/0294371 | A1 | 12/2009 | Garrison | 210/695 |

FOREIGN PATENT DOCUMENTS

| | | |
|---|---|---|
| DE | 4124990 | 1/1993 |
| EP | 0 362 380 | 4/1990 |
| EP | 0 839 577 | 5/1998 |
| EP | 2103354 | 9/2009 |
| FR | 2488149 | 2/1982 |
| NL | 1 030 761 | 6/2007 |
| WO | WO 2004/002900 | 1/2004 |
| WO | WO 2007/139568 | 12/2007 |
| WO | WO 2009/108047 | 9/2009 |

* cited by examiner

DEVICE FOR AND METHOD OF SEPARATING SOLID MATERIALS ON THE BASIS OF A MUTUAL DIFFERENCE IN DENSITY

The present invention relates to a device for separating solid materials on the basis of a mutual difference in density, wherein the materials to be separated are brought into contact with a magnetic fluid across which fluid a density gradient is generated by means of a magnetic field such that fractions of solid materials of different densities are obtained, said device being provided with a magnet, an inflow chamber, a separation chamber, and means for separately discharging fractions of solid materials of different densities in separation, and wherein the magnetic fluid flows from the inflow chamber to the separation chamber. The invention further relates to a method of separating solid materials on the basis of a mutual difference in density, wherein the materials to be separated are brought into contact with a magnetic fluid.

Such a method is known per se from the present Applicant's NL 1 030 761 in which it is described that solid particles can be separated over a wide density range through a suitable choice of the strength of the magnetic fluid. The magnetic field used therein is created by a permanent magnet composed of strips of at least two alternating orientations, in particular an alternating orientation of east, north, west, and south.

The method mentioned in the opening paragraph is known from NL 2 001 322 (WO 2009/108047), wherein a quantity of solid materials to be separated is first thoroughly mixed into a small partial flow of the magnetic fluid, whereupon the turbulent partial flow thus obtained is added to a large partial flow of the magnetic fluid, whereby the solid particles of low density and the solid particles of high density are separated from the magnetic fluid, dried, and stored.

A method is known from U.S. Pat. No. 4,062,765 wherein a separation of a mixture of non-magnetic particles on the basis of the different densities thereof is achieved through the use of a magnetic fluid, utilizing a plurality of magnetic intermediate spaces formed by a grid of magnetic poles which are mutually oriented such that the polarity of the magnetic field generated in each intermediate space is opposed to that of each adjoining intermediate space. Because of the necessary presence of intermediate spaces, particles with a density higher than the apparent density of the magnetic fluid will pass through the plane of the critical points at these critical points and be discharged in downward direction through the openings in the intermediate spaces to a vessel situated therebelow. A non-uniform magnetic field gradient is generated in the magnetic fluid, which gradient produces in the magnetic fluid a vertical force component in a direction opposed to that of gravity, which vertical force component decreases in strength in a direction opposed to that of gravity and comprises the critical points below which the contours of constant force are discontinuous and above which the contours of constant force are continuous. A disadvantage of such a configuration is that the volume with the strongest magnetic field is occupied by the sink fraction, FIG. 5 of the cited US Patent clearly showing that particles of the floating fraction must not come closer than contour 300 so as not to run the risk of sinking, whereas the magnet generates forces of level 700. Another disadvantage of such a configuration is that magnetic materials will attach themselves to the poles and that even non-magnetic materials from the sink fraction may come to lie around and on the magnet poles, which may lead to clogging. It is accordingly desirable in order to avoid aggregation of particles, according to FIG. 5, that the floating fraction cannot continue further than the contour 100-200, which renders the method according to this US Patent very unattractive in terms of magnetic efficiency.

European Patent Application 0 839 577 discloses a ferrohydrostatic separation method wherein the apparent density of a so-termed ferro fluid is controlled by a solenoid. Such a separation device is said to be capable of separating a material into one or more fractions comprising floating, suspended and sinking fractions.

European Patent Application 0 362 380 discloses a ferrohydrostatic separator wherein the separation takes place on the basis of density differences. The method described therein has four major disadvantages: (a) magnetic particles in the feed will be attracted to the poles and cause obstructions, (b) the feed is separated into no more than two product flows, (c) the width of the slit cannot very well be enlarged; at greater slit widths the particles tend to drop towards the centre so that the separation space is inefficiently utilized, and (d) electrical energy is needed for maintaining the field.

U.S. Pat. No. 3,788,465 discloses a device for a so-termed magneto-gravimetric separation, wherein the magnetic field exerts forces on particles immersed in the magnetic fluid such that it is possible to separate into several fractions. The arrangement is tilted such that the field strength decreases mainly in horizontal direction. Depending on the density, the particles drop through the fluid at different angles to the perpendicular, so that it is possible in principle to separate a large number of product flows, each with its own density. The document states that the method can also treat magnetic particles. This, however, would seem to be unlikely. A disadvantage of such a construction is the size increase possibility and the fact that the particles are discharged in different directions, which implies that the particles must be fed in very accurately along a line or that the separation space is to be made very large so as to obtain a good separation sharpness.

U.S. Pat. No. 3,483,968 discloses a method of separating materials of different densities which utilizes a magnetic field with a certain vertical gradient such that objects of different densities will each seek to occupy a certain position in the fluid. Solid particles will float at different levels so that they can be readily separated. According to this US Patent, a magnetic field is used that decreases more slowly than linearly in upward direction, with the result that particles of different densities will each float at a level specific to the relevant density and can be collected separately at that level. The particles have a tendency to drop away to the sides of the container along the equipotential planes, which leads to homogeneity problems, owing to the use of a magnetic field with a single direction (vertical in this case).

U.S. Pat. No. 5,541,072 relates to a magnetic separation method utilizing magnetic particles in a multiphase system. The magnetic particles associate themselves with a 'target substance' in the carrier fluid, whereupon a separation takes place under the influence of a magnetic field. A number of biological substances are mentioned as the materials to be separated.

U.S. Pat. No. 6,136,182 discloses more or less the same principle as U.S. Pat. No. 5,541,072 mentioned above, in particular as regards the magnetic labelling of so-termed 'target entities'.

DE 4124990 relates to a magnetic field separator for separating ferromagnetic metal parts from suspensions, in particular during the reprocessing of waste paper. This German Offenlegungsschrift is not related to a method for separating solid materials on the basis of a mutual difference in density wherein the materials to be separated are brought into contact with a magnetic fluid across which fluid a density gradient is generated by means of a magnetic field.

EP 2 103 354 relates to a classification apparatus, comprising: a dispersion liquid inlet channel that introduces a dispersion liquid containing particles; a classification channel that classifies the particles; and at least one discharge channel that discharges the classified particles, wherein the classification channel is provided inclinedly to a direction of gravity. This document teaches that it becomes possible to broaden the range of particles to which the classification method is applicable by loading an external force being in proportion to particle diameter in addition to the difference in sedimentation velocity. As such an external force, an electric field or a magnetic field may be cited.

FR 2488149 relates to a method and an apparatus to treat gaseous waste by using a magnetic separation process.

DE 36 24 626 relates to a method to the separation of cloths from a material mixture by bringing the material mixture with magnetic liquid in contact, which possesses one for sorbing the cloths suitable composition, in a sorption container in which magnetic or magnetizable installations are contained.

WO 2007/139568 relates to a molecular arrangement magnetic treatment apparatus comprising: a material container with an inlet and an outlet wherein material to be treated is introduced; a material passageway connected at one end to said inlet and at another end to said outlet and at least one pair of magnets oriented such that material in said passageway must pass between a north pole and a south pole of said at least one pair of magnets.

WO 2004/002900 relates to a waste water purification system comprising chemicals-free filtration means for physically filtering the polluted water with chemicals-free treatment, and coagulation and separation means for forming magnetic flocs containing pollutant particles, phosphorus and the like by infusing a coagulant and a magnetic powder, and for separating the magnetic flocs, wherein the magnetic flocs are magnetically separated and collected as sludge.

U.S. Pat. No. 5,039,426 relates to a process for continuously separating components of particulate and macromolecular materials.

It is an object of the present invention to provide a method and a device for the separation of solid materials on the basis of a mutual difference in their densities such that the problems identified in the prior art as described above are avoided.

Another object of the invention is to provide a method and a device for the separation of solid materials on the basis of a mutual difference in their densities wherein the presence of unwanted solid particles in the obtained separated fractions is reduced to a minimum.

Another object of the invention is to provide a method and a device for the separation of solid materials on the basis of a mutual difference in their densities wherein solid materials with a density lower than that of water are separated.

The device mentioned in the opening paragraph is according to the present invention characterized in that the magnet is located above the separation chamber and in that at least a duct for the supply of the solid materials to be separated is located below the inflow chamber and the separation chamber and encloses an angle with the inflow chamber and the separation chamber.

The use of such a device achieves one or more of the above objects. The inventors have recognized in particular that, if such a construction is used, it is desirable to uncouple the separation zone, i.e. the area where the magnetic field is active in the magnetic fluid, from the feed zone, i.e. the area in which the solid materials to be separated are supplied in a turbulent flow, as is the case in NL 2 001 322 cited above.

The expression 'enclose an angle with' signifies that the duct for the supply of the solid materials to be separated does not extend parallel to the direction of flow of the magnetic fluid present in the inflow chamber and separation chamber.

The inventors have assumed that the use of the present device renders it possible to introduce the solid materials into the magnetic fluid in a simple manner beyond the 'energy threshold' of the magnetic field. The use of the device according to the invention is also found to render it possible to minimize the presence of solid materials having a density higher than the density contours of the magnetic fluid in the area where the magnetic field is active. This is because said solid materials with a too high density will not float and accordingly will sink themselves, so that they will never enter the inflow chamber and separation chamber at all. The supply of solid materials with a too high density relative to the density of the magnetic fluid is thus reduced to a minimum. An upward force prevails in the duct for the supply of the solid materials to be separated, causing the solid materials to rise in the fluid, in particular owing to their lower density compared with that of the fluid. The magnetic fluid is preferably water-based, but in certain embodiments it is also possible to use a magnetic fluid based on an organic substance, for example kerosene.

In a special embodiment it is particularly desirable that the duct for the supply of the solid materials to be separated is arranged perpendicularly to the inflow chamber and the separation chamber. The positioning of the duct for the supply of the solid materials to be separated perpendicular to the inflow chamber and separation chamber provides an optimum separation of solid materials in the magnetic fluid.

In a preferred embodiment, it is desirable that the duct for the supply of the solid materials to be separated issues into the separation chamber. A magnetic field is active in said separation chamber, so that the magnetic fluid present and flowing therein comprises a plurality of density gradients. The solid materials to be fed in will accordingly be immediately subjected to a density gradient in the magnetic fluid, whereupon the separation of solid materials on the basis of a mutual difference in density will be immediately achieved and agglomeration of solid particles is reduced to a minimum. It is desirable that the duct for the supply of the solid materials to be separated issues into the separation chamber in a location where the magnetic field is already active, i.e. in a location in the magnetic field itself. The duct for the supply of the solid materials to be separated may comprise a plurality of ducts in a certain embodiment. The input or feed of the solid materials to be separated then takes place in various locations in the separation chamber.

The means for separately discharging fractions of solid materials of different densities is preferably located at a distance from the duct for the supply of the materials to be separated. An optimum use is thus made of the flow direction of the magnetic fluid in the magnetic field, so that the solid materials to be separated have a sufficient residence time for finding the density region suitable for them in the magnetic fluid.

It is particularly desirable that the means for separately discharging fractions of solid materials are provided with a supplementary magnet, which supplementary magnet creates a magnetic field in the means for separately discharging fractions of solid materials, in particular in the magnetic fluid present therein. The presence of such a supplementary magnetic field prevents the already separated fractions from experiencing the density of water, which density of water may lead to particles starting to float or sink in an undesirable manner. Undesirable sinking, rising and/or agglomeration effects are thus reduced to a minimum.

The present invention is further characterized in that the duct for the supply of the materials to be separated comprises a feed part, a rising part, and a discharge part, of which said rising part issues into the bottom of the separation chamber while the feed part and the rising part enclose an angle with the rising part, and wherein the feed part, the rising part and the discharge part are in fluid communication with one another.

It is particularly desirable that an internal transport member is present both in the feed part and in the discharge part, in particular a screw. In such an embodiment, the solid materials to be separated will be guided through the duct for the supply of the materials to be separated such that the solid materials having a density lower than that of the magnetic fluid will enter the separation chamber via the rising part. The solid materials having a density higher than that of the magnetic fluid will remain in the discharge part and the feed part, whereupon such solid materials can be discharged through the discharge part by the internal transport member. Solid materials having a higher density may be iron, glass, sand, heavy synthetic materials, and non-ferro metals. Since in this manner iron cannot enter the separation chamber through the rising part, no iron can attach itself to the magnet, which is a substantial technical advantage.

In order to detach the solid materials to be separated from one another in the rising part, it is desirable in certain embodiments that the interior of the rising part is provided with means for preventing mutual adhesion, for which in particular partitioning walls or baffles may be used. Such walls provide a fluid flow that is somewhat obstructed, so that the solid materials to be separated are separated from one another in the rising part already and can find the density region corresponding to their own density immediately upon entering the magnetic field.

The present invention further relates to a method of separating solid materials on the basis of a mutual difference in density, wherein the materials to be separated are brought into contact with a magnetic fluid across which fluid a density gradient is generated by means of a magnetic field such that fractions of solid materials of different densities are obtained, characterized in that the solid materials to be separated are fed into the magnetic fluid under the influence of an upwardly directed force, and the direction of flow of the magnetic fluid encloses an angle with the solid materials to be supplied to the magnetic fluid.

It was found that the supply of the solid materials to be separated to the magnetic fluid by means of an upwardly directed force renders it possible to counteract an undesired agglomeration of the solid particles to be separated. Preferably, there is no magnetic field in the area where the upward force is exerted. The too heavy solid materials, in relation to the density of the magnetic fluid, will not enter the magnetic field, whereby a possible malfunction of the separation process is prevented. Furthermore, the use of the upward force has the result that the lightweight particles will move more quickly through the fluid in the feed part than the comparatively heavy particles. The differences in density among the solid materials to be separated are thus optimally utilized without a magnetic field being active.

It is particularly desirable that the supply of the solid materials to be separated takes place at the level of the magnetic field generated by the magnet.

It is especially preferred in the present invention that the supply of the solid materials takes place through a supply duct comprising a feed part, a rising part, and a discharge part, wherein the rising part issues into a space in which the magnetic fluid flows, the feed part and the discharge part enclose an angle with the rising part, and the feed part and discharge part are in fluid communication with one another.

In order to achieve an optimum separation of the solid materials on the basis of a mutual difference in density, it is desirable that the magnetic fluid exhibits a laminar flow pattern, in particular that the fractions of solid materials separated on the basis of their density differences by the magnetic fluid are separately removed from the magnetic fluid.

After the solid materials have been separated on the basis of the mutual difference in density, it is desirable to remove the magnetic fluid adhering to the fractions therefrom, which magnetic fluid is preferably recycled back to the magnetic fluid.

A permanent magnet, electromagnet, or superconductive magnet is used as the magnet in the inventive method. It is especially desirable that the magnet configuration as disclosed in Applicant's NL 1 030 761 be used, wherein a minimum distance between the upper side of the magnet and the magnetic fluid is chosen such that the magnetic field in the magnetic fluid is substantially constant in both horizontal directions, while the magnetic field decreases exponentially in vertical direction in the magnetic fluid. It is particularly desirable that the magnetic field is created by a permanent magnet composed of strips of at least two different orientations, and that said strips of the magnet are provided with rounded corners at the side facing the magnetic fluid.

The present invention in particular envisages an embodiment in which the solid materials to be separated have densities lower than that of water, for example polymers such as polyethylene and polypropylene. It is alternatively possible, however, to apply the present invention to the separation of materials having densities higher than that of water. In such an embodiment, the supply of the fractions of solid materials to be separated will be located above the separation chamber and the inflow chamber and the magnet will be located below said chambers, while preferably the magnet itself is separated from the magnetic fluid. The discharge of the fractions thus separated on the basis of their different densities also takes place by means of a splitter as will be described further below. In a special embodiment, the splitter is preferably provided with a transport member at an end thereof, in particular a screw member. Such a transport member ensures that any undesirable heavy particles are removed from the separated solid fraction. It is also possible in such an embodiment that the member for separately discharging the fractions separated on the basis of their different densities is provided with a supplementary magnet for generating a magnetic field in said splitter.

The present application will now be explained in more detail with reference to a number of figures, but it should be noted that the invention in by no means limited to such a construction.

Figure 1:
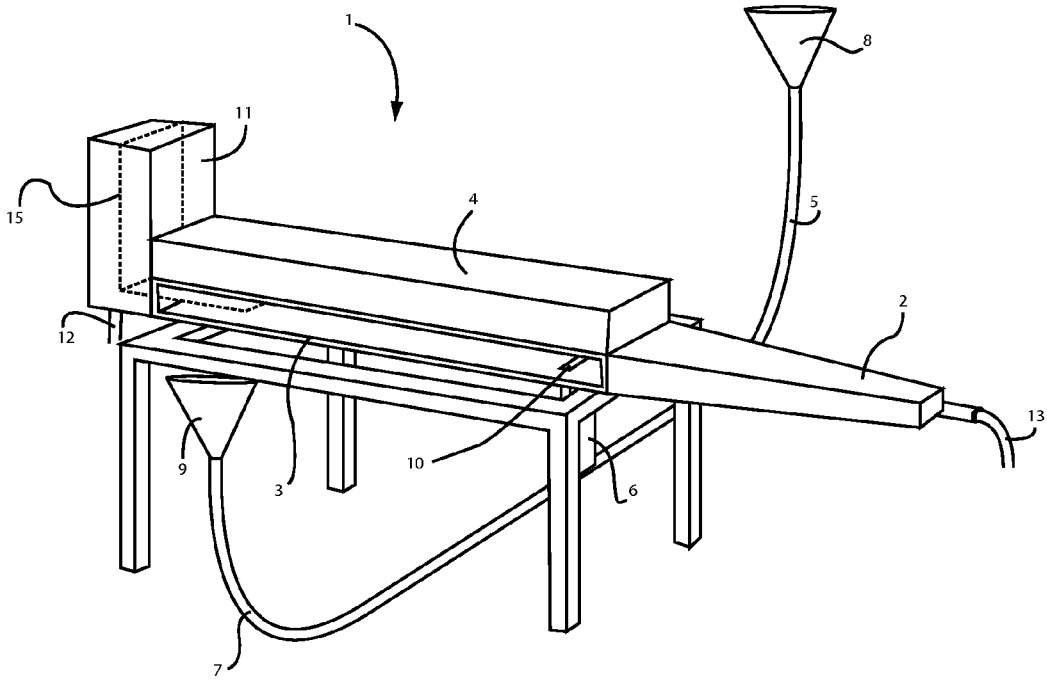
FIG. 1 is an elevation of the device according to the invention.

The device 1 comprises an inflow chamber 2 and an adjoining separation chamber 3 above which a magnet 4 is situated. The magnetic fluid flows from the inflow chamber 2 to the separation chamber 3. Means 11 for a separated discharge of fractions of solid materials of different densities are provided at the end of the separation chamber 3. The means 11 comprise a splitter in which a separation plate 15 is present for achieving a separated discharge of fractions of solid materials of different densities. The separation plate 15 is preferably adjustable in height such that the separation of the fractions in the magnetic fluid can take place at a desired height. The height is of importance because density contours have arisen in the magnetic fluid under the influence of the magnet 4. The separation chamber 3 has an opening 10 at its lower side, which opening 10 serves to supply the solid materials to be separated to the separation chamber 3. The opening 10 is located slightly downstream of the magnetic field generated by the magnet 4. The opening 10 is for this purpose connected to a duct for the supply of the materials to be separated, comprising a feed part 5, a rising part 6, and a discharge part 7. An internal transport member (not shown) is present in the duct for the supply of the materials to be separated, in particular in the feed part 5 and the discharge part 7. The opening 10 may in fact be formed by a plurality of openings, each connected to a duct for the supply of materials to be separated, which duct may comprise a plurality of ducts. The feed part 5 is further provided with a feed opening 8 into which the solid materials to be separated can be introduced. A magnetic fluid is present in the separation chamber 3 and in the inflow chamber 2, which magnetic fluid is introduced through a line 13 and discharged through a line 12. Magnetic fluids or ferrofluids are commonly known fluids which often comprise a suspension of iron oxide particles. In a special embodiment, the magnetic fluid discharged through the line 12 is guided back into the inflow chamber 2 through the line 13. It is clearly visible in the figure that the duct for the supply of the solid materials to be separated is present below the inflow chamber 2 and the separation chamber 3, in particular at the beginning of the separation chamber 3. The position of the duct for the supply of the solid materials to be separated is chosen such that this duct issues into the magnetic field. The magnet 4 generates a magnetic field in the magnetic fluid, and the duct for the supply of the materials to be separated preferably issues into the magnetic field. The opening 10 is accordingly located downstream of the beginning of the magnetic field in the figures. The magnetic fluid is fed in through the inflow chamber 2 into the separation chamber 3 and will displace itself in a laminar flow pattern horizontally through the separation chamber 3. Density contours will establish themselves in the magnetic fluid owing to the presence of the magnet 4 above the separation chamber 3. The solid materials to be separated, supplied through the opening 8 and fed in through the feed part 5, will move in the rising part 6 through the opening 10 into the separation chamber 3 under the influence of the upward force. The opening 10 may extend over the full width of the separation chamber 3. It is desirable that a magnetic fluid should be present in the feed part 5, rising part 6, and discharge part 7, while the magnetic fluid present in the rising part 6 will ensure that the solid materials to be separated are moved to the separation chamber 3 under the influence of the upward force. Solid materials present in the feed part 5, rising part 6, and discharge part 7 and heavier than the density of the magnetic fluid will not move into the separation chamber 3. Thus, for example, iron cannot enter the separation chamber 3, so that such particles cannot attach themselves to the magnet 4 with the accompanying disturbance of the separation process. The presence of a transport screw (not shown) ensures that such heavy solid materials are removed through the discharge part 7 and discharge opening 9. In a special embodiment it is possible that a wetting agent is present in the magnetic fluid so as to promote the separation of solid materials. It is desirable for the fluid to be at the same level in the splitter 11, discharge part 5, and feed part 7. In addition, the separation of solid materials in the magnetic fluid may be further enhanced in that anti-foaming agents and or pH regulating agents are added to the magnetic fluid. Although the device in the figure is shown to have only one rising part 6, it is possible in a special embodiment that a supply of solid materials to be separated takes place in a plurality of positions in the inflow chamber 2 and/or the separation chamber 3. It is furthermore possible that means are present in the inflow chamber 2 for promoting the laminar flow of the magnetic fluid. A suitable, preferred magnet configuration to be used for the magnet 4 is found in the construction disclosed in NL 1 030 761.

Figure 2:
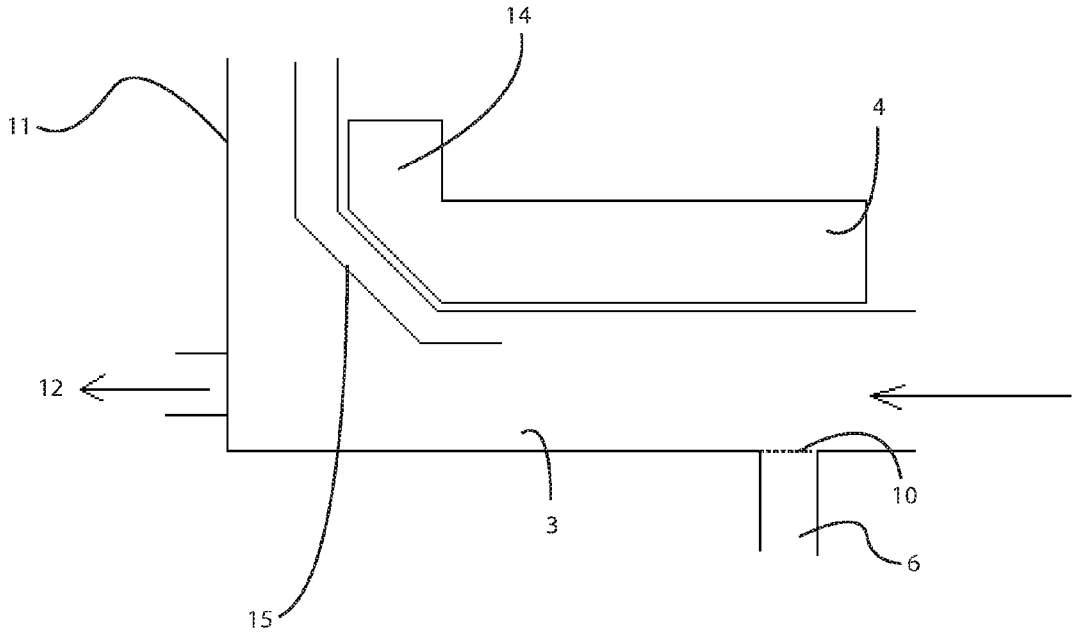
FIG. 2 shows a special embodiment of the magnet and the splitter in a diagrammatic elevation.

FIG. 2 is a diagrammatic side elevation of a special embodiment of the magnet 4 and the splitter 11. Since the fractions of solid materials present in the splitter 11 are separated on the basis of their mutual differences in density, it is desirable that a discharge of the fractions can take place without problems. It is accordingly preferred in certain embodiments that a magnetic field is active also in the splitter 11. This magnetic field is realized in that the splitter is provided at its exterior with a magnet 14, which magnet 14 may be integral with the magnet 4 in a special embodiment. The magnet 14 ensures that the magnetic fluid present in the splitter 11 is subjected to a magnetic field owing to which the solid particles therein do not tend to sink, rise, or clog, so that the risk of obstructions is reduced. The construction of the magnet 14 may be such that the outer contours of the splitter are closely followed.

The invention claimed is:

1. A device for separating solid materials on the basis of a mutual difference in density, wherein the materials to be separated are brought into contact with a magnetic fluid across which fluid a density gradient is generated by means of a magnetic field such that fractions of solid materials of different densities are obtained, said device being provided with a magnet, an inflow chamber, a separation chamber, and means for separately discharging fractions of solid materials of different densities, and wherein the magnetic fluid flows from the inflow chamber to the separation chamber, wherein the magnet is located above the separation chamber and in that at least a duct for the supply of the solid materials to be separated is located below the inflow chamber and the separation chamber and encloses an angle with the inflow chamber and the separation chamber, and wherein the duct for the supply of the materials to be separated comprises a feed part, a rising part, and a discharge part, of which said rising part issues into the bottom of the separation chamber while the feed part and the rising part enclose an angle with the rising part, and wherein the feed part, the rising part and the discharge part are in fluid communication with one another.

2. The device according to claim 1 wherein the duct for the supply of the solid materials to be separated is arranged perpendicularly to the inflow chamber and the separation chamber.

3. The device according to claim 1 wherein the duct for the supply of the materials to be separated is located at a distance from the means for separately discharging fractions of solid materials of different densities, wherein said means for separately discharging fractions of solid materials are provided with a supplementary magnet, which supplementary magnet creates a magnetic field in the means for separately discharging fractions of solid materials.

4. The device according to claim 1 wherein an internal transport member is present both in the feed part and in the discharge part.

5. The device according to claim 4 wherein said internal transport member is a screw.

6. The device according to claim 1 wherein the rising part is provided, in the interior thereof, with means for preventing a mutual adhesion of the solid materials to be separated.

7. The device according to claim 6 wherein the rising part is provided with internal obstruction means, in particular partitioning walls.

8. A method of separating solid materials on the basis of a mutual difference in density, wherein the materials to be separated are brought into contact with a magnetic fluid across which fluid a density gradient is generated by means of a magnetic field such that fractions of solid materials of different densities are obtained, wherein the solid materials to be separated are fed into the magnetic fluid under the influence of an upwardly directed force and the direction of flow of the magnetic fluid encloses an angle with the solid materials to be supplied to the magnetic fluid, and wherein the supply of the solid materials takes place through a supply duct comprising a feed part, a rising part, and a discharge part, wherein the rising part issues into a space in which the magnetic fluid flows, the feed part and the discharge part enclose an angle with the rising part, and the feed part and discharge part are in fluid communication with one another.

9. The method according to claim 8, wherein the supply of the solid materials to be separated takes place at the level of the magnetic field generated by the magnet.

10. The method according to claim 8 wherein an internal transport member is present both in the feed part and in the discharge part.

11. The method according to claim 10 wherein said internal transport member is a screw.

12. The method according to claim 8 wherein a fluid is present in the supply duct.

13. The method according to claim 8 wherein the magnetic fluid exhibits a laminar flow pattern in the magnetic field generated by the magnet.

14. The method according to claim 8 wherein the fractions of solid materials separated on the basis of their density differences by the magnetic fluid are separately removed from the magnetic fluid.

15. The method according to claim 14 wherein the fractions of solid materials of different densities removed from the magnetic fluid are divested of adhering magnetic fluid, which magnetic fluid thus retrieved is fed back to the magnetic fluid.

16. The method according to claim 8 wherein the magnet is a permanent magnet, an electromagnet, or a superconductive magnet.

17. The method according to claim 8 wherein the materials to be separated comprise combinations of synthetic materials.

18. The device according to claim 1 wherein the duct for the supply of the solid materials to be separated issues into the separation chamber, and wherein the duct for the supply of the materials to be separated is located at a distance from the means for separately discharging fractions of solid materials of different densities, wherein said means for separately discharging fractions of solid materials are provided with a supplementary magnet, which supplementary magnet creates a magnetic field in the means for separately discharging fractions of solid materials.

19. A device for separating solid materials on the basis of a mutual difference in density, wherein the materials to be separated are brought into contact with a magnetic fluid across which fluid a density gradient is generated by means of a magnetic field such that fractions of solid materials of different densities are obtained, said device being provided with a magnet, an inflow chamber, a separation chamber, and means for separately discharging fractions of solid materials of different densities, and wherein the magnetic fluid flows from the inflow chamber to the separation chamber, wherein the magnet is located above the separation chamber and in that at least a duct for the supply of the solid materials to be separated is located below the inflow chamber and the separation chamber and encloses an angle with the inflow chamber and the separation chamber;

wherein the duct for the supply of the solid materials to be separated issues into the separation chamber; and wherein the duct for the supply of the materials to be separated is located at a distance from the means for separately discharging fractions of solid materials of different densities, wherein said means for separately discharging fractions of solid materials are provided with a supplementary magnet, which supplementary magnet creates a magnetic field in the means for separately discharging fractions of solid materials.

* * * * *